US007635072B2

(12) United States Patent
Bo-Seob et al.

(10) Patent No.: US 7,635,072 B2
(45) Date of Patent: Dec. 22, 2009

(54) TACKER HAVING ANTI-DOUBLE FIRING DEVISE FOR SINGLE FIRING MODE

(75) Inventors: Cho Bo-Seob, Seoul (KR); Kim Jae-Sung, Seoul (KR); Hwang In-Sung, Incheon (KR); Kim Myung-Kyun, Seoul (KR)

(73) Assignee: JEIL TACKER Co. Ltd., Gwangju-Si, Gyeonggi-Do (KR)

( * ) Notice: Subject to any disclaimer, the term of this patent is extended or adjusted under 35 U.S.C. 154(b) by 0 days.

(21) Appl. No.: 11/255,837

(22) Filed: Oct. 20, 2005

(65) Prior Publication Data

US 2006/0213947 A1 Sep. 28, 2006

(30) Foreign Application Priority Data

Mar. 22, 2005 (KR) ..... 10-2005-0023773

(51) Int. Cl.
*B25C 1/04* (2006.01)

(52) U.S. Cl. ..... 227/8; 227/130

(58) Field of Classification Search ..... 227/8, 227/130, 120

See application file for complete search history.

(56) References Cited

U.S. PATENT DOCUMENTS

| | | | | |
|---|---|---|---|---|
| 5,836,501 | A * | 11/1998 | Lai | 227/8 |
| 6,213,372 | B1 * | 4/2001 | Chen | 227/8 |
| 6,659,324 | B1 * | 12/2003 | Liu | 227/8 |
| 6,675,999 | B2 * | 1/2004 | Mukoyama et al. | 227/8 |
| 6,953,137 | B2 * | 10/2005 | Nakano et al. | 227/8 |
| 7,073,697 | B2 * | 7/2006 | Lin | 227/8 |

* cited by examiner

*Primary Examiner*—Rinaldi I. Rada
*Assistant Examiner*—Lindsay Low
(74) *Attorney, Agent, or Firm*—GWiPS

(57) ABSTRACT

A tacker having an anti-double firing devise for a single firing mode has developed comprising: a connector (100') for linearly moving back and forth along an ejection guide (4) when the tacker is depressed or released on a work target, a detent (**100*a*') formed a tiny rectangular shaped cutout at proximal end of the connector (100'), a firing control plate (94) for pushing a piston valve rod (12) by its stroke into a cylinder of an operating unit (10) according to the movement of the connector (100'), and an anti-double firing controller (102) forming an index-finger shape with slightly bent finger tip, which has a flat top surface and a rounded-tip lower surface for easily engaging or disengaging to the detent (100*a*'). The anti-double firing controller (102) is latched into the detent (100*a*') soon after a firing for preventing subsequent misfiring on the same target due to a repulsion of the connector (100'**) for a single firing mode.

1 Claim, 7 Drawing Sheets

TACKER HAVING ANTI-DOUBLE FIRING DEVISE FOR SINGLE FIRING MODE

Pursuant to 35 U.S.C. § 119(a), this application claims the benefit of earlier filing date and right of priority to Korean Patent Application No. 10-2005-0023773, filed on Mar. 22, 2005, the content of which is hereby incorporated by reference herein in its entirety.

BACKGROUND OF THE INVENTION

1. Field of the Invention

The present invention relates to an anti-double firing devise for a single firing mode in a tacker, and more particularly the anti-double firing devise comprising an anti-double firing controller coaxially mounted to a firing control plate and a detent located at the proximal end of a connector to latch the anti-double firing controller for preventing a duplicated shot on a same target while a single firing mode is selected.

2. Description of the Related Prior Art

As well known to those skilled in the art, a tacker-nailer, a stapler, and a pinner, which are used in construction and interior works, are pneumatic machines for fastening a wooden article to another wooden article, a wooden article to a plastic article, a wooden article to a steel article, or a wooden article to a concrete article, and are used in various works, such as exterior works and aluminum chassis works.

Generally, as shown in FIG. 1, a tacker comprises a body 1 having a piston and a cylinder installed therein, a cover 2 for providing air to, and eliminating air from, the piston, a magazine 3 loaded with nails, staples or pins, and a guide 4 for launching the nails, a safety device 5 for ensuring safe operation, a latch device 6 for loading the tacker with nails, a bracket 7 for connecting the magazine 3 to a handle grip 8 to obtain the firm structure of the tacker, and a trigger 9 for driving the tacker.

In the above tacker, the trigger 9 is operated to move the piston installed in the body 1, thereby allowing the nails or the staples loaded in the magazine 3 to go through a desired position of an object through the guide 4.

Most of conventional tackers further comprise all or one of continuous and single firing switches and a locking device, or do not comprise any one of them. Further, most of conventional tackers comprise or do not comprise the safety device 5. A single firing operation is performed to obtain a precision work, and a continuous firing operation is performed to increase user's convenience and efficiency. The locking device is used to prevent accidents caused by user's carelessness.

More particularly, with reference to FIGS. 2A, 2B, 2C, and 2D, single and continuous firing methods using a conventional tacker, such as a nailer, will be illustrated. A safety device 5 is provided at the front end of the tacker and is connected to a connector 100, as shown in FIG. 2A, which is installed in the guide 4. If the connector 100 does not move to the rear end of the tacker in the single or continuous firing position, nails are not launched. Thereby, the tacker prevents accidents caused by user carelessness.

In the single firing mode in the conventional tacker, the tacker has an initial position as shown in FIG. 2*a*. In the above position, a user brings the front tip of the connector 100 of the tacker into contact on a target, and presses the tacker against the target. Then, as shown in FIG. 2*b*, the connector 100 linearly moves backward to an operating member 10 (in the direction of B), and the rear end of the connector 100 pushes a firing control plate 94, mounted on the lower end of a trigger 92 by an axle pin 96, to the operating member 10 by a designated length.

Thereby, due to the backward movement of the firing control plate 94, a piston valve rod 12, which is protruded from the operating member 10, is pushed into the cylinder of the operating member 10, by a designated length.

Under the above state, when the user pulls the trigger 92, as shown in FIG. 2*c*, the lower end of the trigger 92 moves in the arched direction of A, with respect to a rotating shaft pin 97 mounted at the upper end of the trigger 92. Then, the firing control plate 94 mounted on the trigger 92 by the axle pin 96 completely pushed back the piston valve rod 12 into the cylinder of the operating member 10. When the piston valve rod 12 is completely stroked into the cylinder of the operating member 10, the nails 11 loaded in the ejection guide are launched forward.

The firing control plate 94 mounted on the lower end of the trigger 92 by the axle pin 96 is operated by the connector 100 to push the piston valve rod 12 into the cylinder of the operating member 10. Therefore, when the trigger 92 is pulled while the connector 100 is depressed on the target, the firing control plate 94 will be rotated with respect to the contacting point of the connector 100 and the firing control plate 94 to push back the stroke of the piston valve rod 12 into the cylinder of the operating member 10 for firing.

In the continuous firing operation using the conventional tacker, in which a user does not fire one tacker pin but fires several tacker pins toward a broad area of an object in a short time, the user presses the front end of the tacker to a target site under the condition that the user pulls the trigger 92, thereby causing the connector 100 to move toward the operating member 10 (in the direction of B) and the tacker pins to be launched. The fundamental principle of the continuous firing operation is the same as that of the single firing operation. However, in the continuous firing operation, the connector 100 does not contact the object first, but is pressed onto the target site of the object under the condition that the trigger 92 is pulled first.

If the number of target sites of an object is three and the target sites are in close proximity, the user pulls the trigger 92 in the continuous firing mode, and presses the connector 100 against one target site of the object, thereby causing one nail to be launched toward the first target site of the object. Then, the user moves the tacker to another target site of the object under the condition that the trigger 92 is pulled, and presses the connector 100 against the target site of the object, thereby causing other nails to be continuously launched toward the second and third target sites of the object.

In the conventional tacker in the single firing mode, when the connector 100 contacts the target site and the trigger 92 is pulled, a nail is launched onto the target site and the valve rod 12 is pressed again due to the repulsive force of the connector 100 in the same manner as the continuous firing mode. When the valve rod 12 is pressed, the tacker, which should be fired once, is fired twice, thereby causing a difficulty in precisely performing the single firing mode.

SUMMARY OF THE INVENTION

Therefore, the present invention has been made in view of the above problems, and it is an object of the present invention to provide a tacker with anti-double firing means, which comprises an anti-double firing plate installed at the front end of a pushing plate so that a connector does not push the pushing plate once again due to the repulsive force of the connector caused by firing when a trigger is pulled in a single firing mode under the condition that the front end of the tacker contacts a target site of an object and is pressed against the target site and the connector moves backward, to precisely perform a single firing operation.

In accordance with the present invention, the above and other objects can be accomplished by the provision of a tacker with anti-double firing means, the tacker which has a body, a guide installed at the front end of the body, a cover installed at the rear end of the body and provided with a member for controlling compressed air, a handle grip and a trigger installed at the lower end of the body, a magazine installed under the guide and filled with tacker pins, and a pushing plate installed in the trigger for pressing a valve rod for operating a piston, the anti-double firing means comprising: a connector installed in the guide installed at the front end of the body of the tacker such that the connector moves back and forth, and provided with a notch formed in a designated portion of the rear end thereof such that the upper end of an anti-double firing plate is inserted into the notch in a single firing mode; and the anti-double firing plate separated from the pushing plate by a designated distance, coaxially connected to the pushing plate by a connection pin, and restraining the connector from moving backward due to the repulsive force of the connector.

Preferably, a fixing spring connected to the connection pin is fixed to one side of the anti-double firing plate to cause the upper end of the anti-double firing plate to be located close to an operating member.

Further, preferably, a latched plane for preventing the connector from moving backward due to the repulsive force is formed on the front surface of the anti-double firing plate, and a rounded plane for allowing the connector to move toward the front end of the tacker is formed on the rear surface of the anti-double firing plate.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the annexed drawings.

Figure 1:
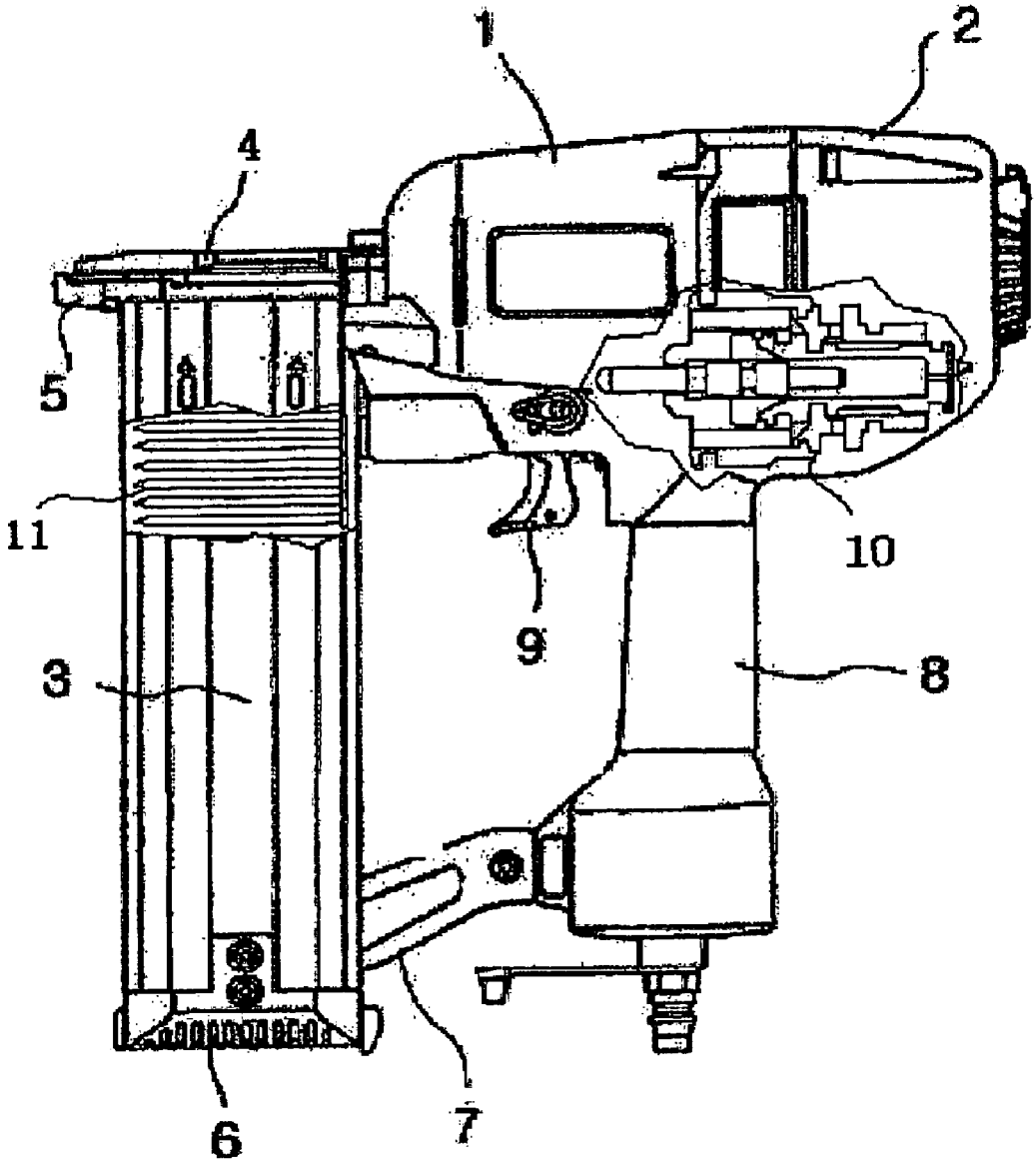
Fig. 1 (Prior Art)
FIG. 1 is a front view of a conventional tacker.
Figure 2A:
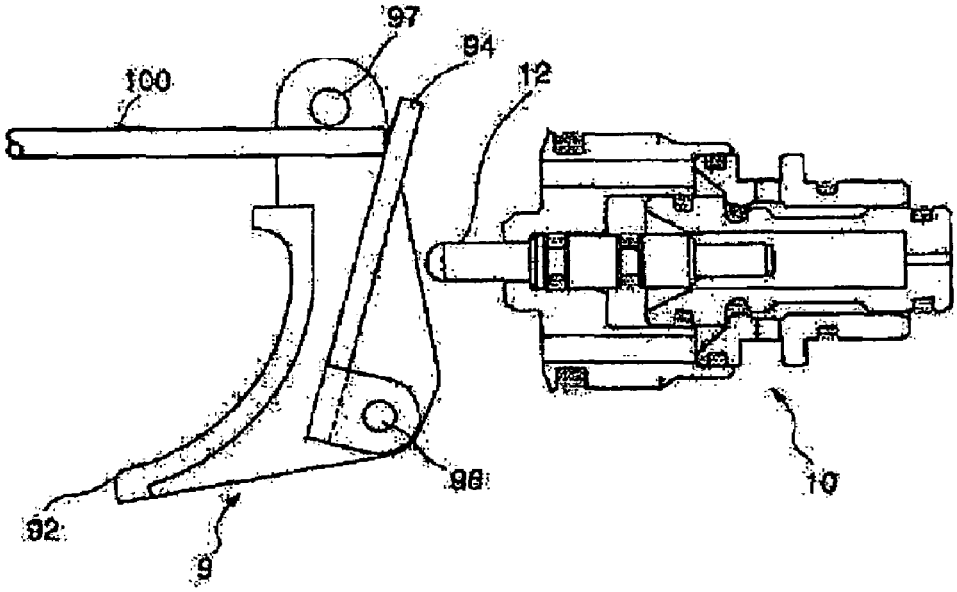
Fig. 2A (Prior Art)
FIGS. 2A, 2B, 2C, and 2D are schematic views illustrating operations of the conventional tacker in single and continuous firing modes.
Figure 2B:
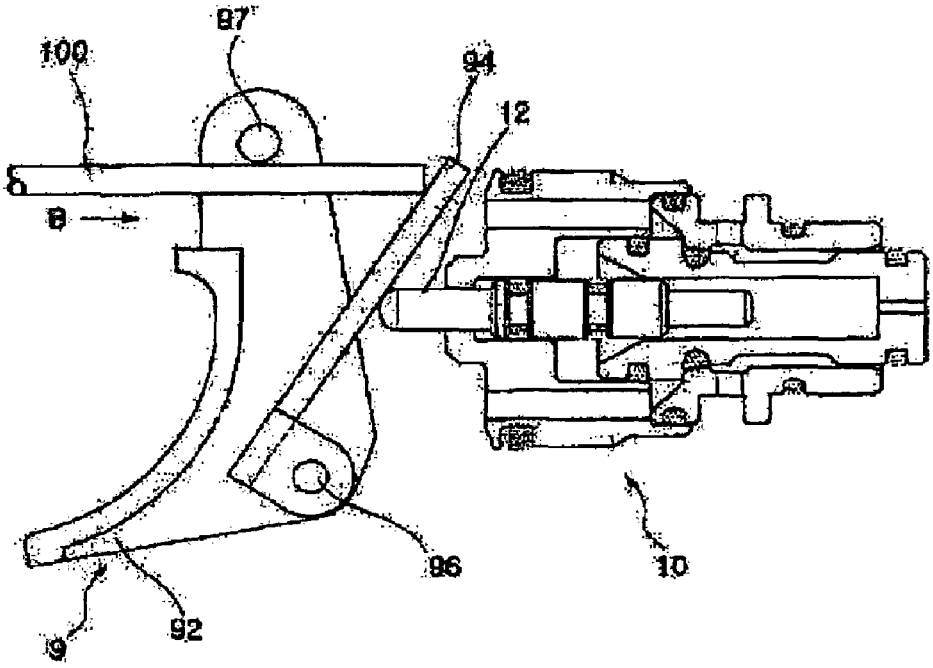
Fig. 2B (Prior Art)
Figure 2C:
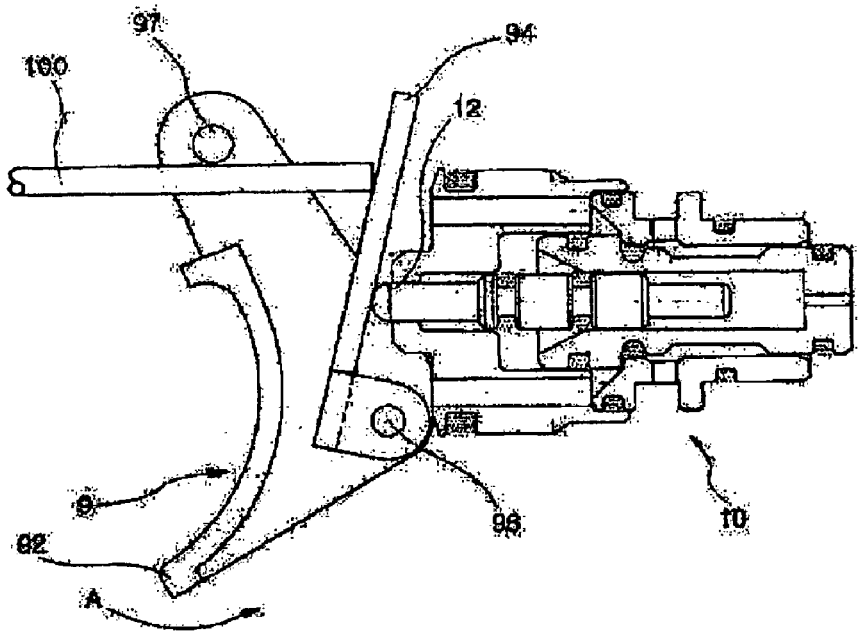
Fig. 2C (Prior Art)
Figure 2D:
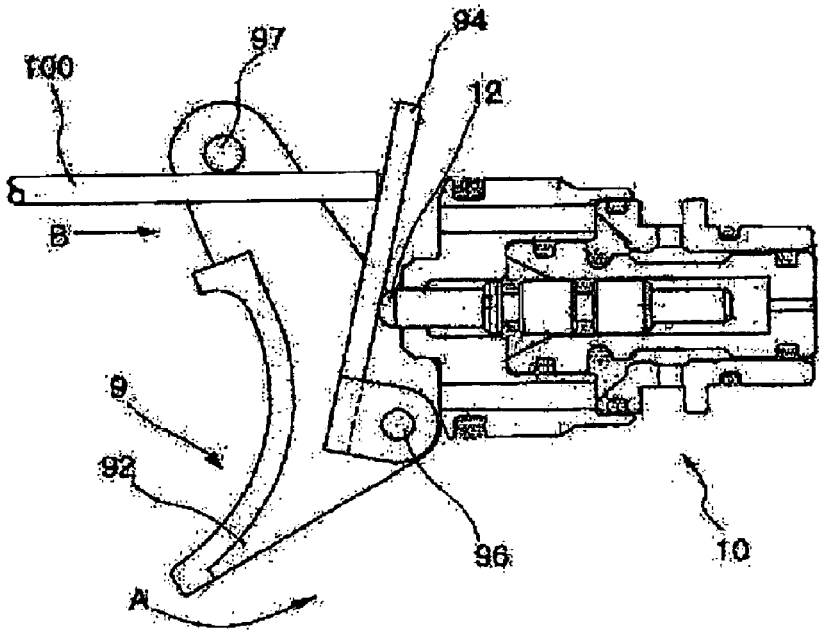
Fig. 2D (Prior Art)
Figure 3A:
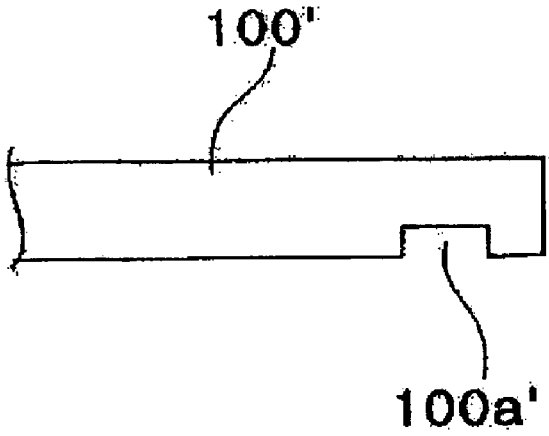
FIG. 3A is a partially detailed view of a connector of a tacker with anti-double firing means in accordance with an embodiment of the present invention.
Figure 3B:
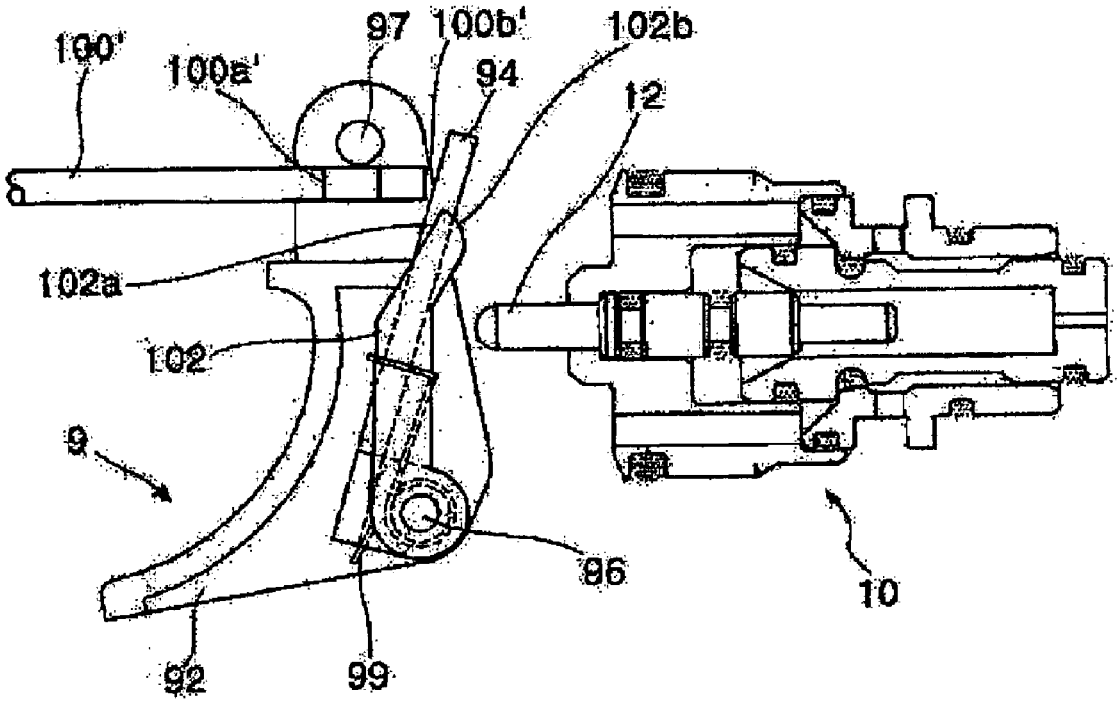
FIGS. 3B, 3C, and 3D are transversal views illustrating the constitution and operation of the anti-double firing means in a single firing mode using the tacker with the anti-double firing means in accordance with the embodiment of the present invention.
Figure 3C:
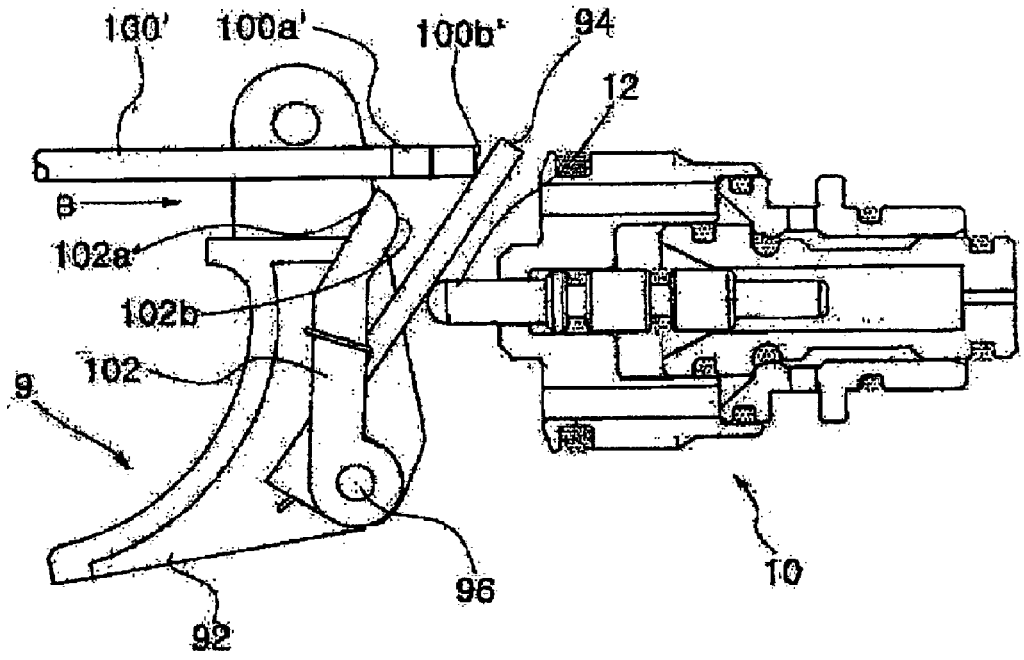
Figure 3D:
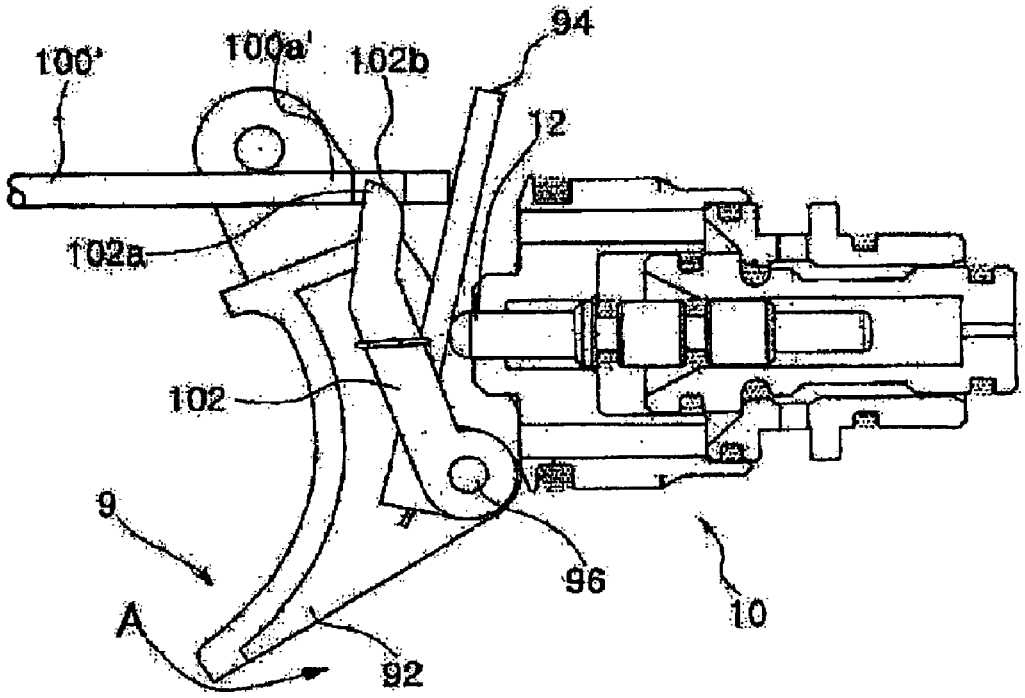

FIG. 3A is a partially detailed view of a connector of a tacker with anti-double firing means in accordance with an embodiment of the present invention. FIGS. 3B, 3C, and 3D are transversal views illustrating the constitution and operation of the anti-double firing means in a single firing mode using the tacker with the anti-double firing means in accordance with the embodiment of the present invention.

With reference to FIGS. 3*a* to 3*d*, an anti-double firing devise in the tacker of the present invention comprises an anti-double firing controller coaxially mounted with a firing control plate on a trigger and a connector for pushing back the firing control plate when a front tip of the connector brings to contact and depress onto the target. The connector also has formed a detent at its proximal end for latching the anti-double firing controller soon after firing a single shot to prevent a duplicated shot on the same target, which is frequently occurred by reaction of the connector due to the repulsion of the firing during a single firing mode.

Since the conventional tacker has such a problem, the anti-double firing devise of the present invention has designed to prevent sequential firing on the same target due to the repulsive force for the single firing mode. The anti-double firing controller 102 will effectively prevent the bouncing of the connector 100' after the single firing by blocking to push back the firing control plate 94.

First, the configuration of the anti-double firing devise of the present invention will be described in detail. The anti-double firing devise comprises the connector 100' installed along the ejection guide 4 and stick out the front tip of the connector 100' for moving back and forth. A detent 100*a*' is formed a rectangular cutout located proximal end of the connector 100' to latch the upper end of the anti-double firing controller 102 for the single firing mode.

The upper end of a trigger 92 is rotatably mounted on the lower front end of a body 1 by a rotation pin 97, and the firing control plate 94 is mounted on the lower back end of the trigger 92 by a axle pin 96.

The operating member 10 activates the nail striking pneumatic mechanism by pulling the trigger 92. The piston valve rod 12 is stroked back into the cylinder of the operating member 10 when the trigger 92 is pulled while the connector 100' is contacted and depressed on the target.

The anti-double firing controller 102, which is coaxially mounted with the firing control plate 94 by the axle pin 96, is separately activated as the connector 100' moving backward. A coil spring 99 is installed for exerting a resilient force to the anti-double firing controller 102 by the axle pin 96, thereby the upper end of the anti-double firing controller 102 formed a bent finger tip shape is consistently maintained its position for latching or unlatching the detent of the connector 100'.

A front top surface 102*a* of the slightly bent finger tip shape of the anti-double firing controller 102 is latched into the detent for restricting the bounced connector 100' due to the repulsive force, so that the connector 100' is blocked not to push backward the firing control plate 94. The rounded tip lower surface 102*b* of the slightly bent finger tip shape of the anti-double firing controller 102 is easily unlatched from the detent 100*a*' when the connector 100' returns back to the initial position of the single shot mode.

Now, the operation of the anti-double firing devise of the present invention for the single firing mode will be described in detail. As shown in FIG. 3*b*, an initial state of the anti-double firing devise is presented for the single firing mode. In the above state, a user brings the tip of the connector 100' to contact on a target and presses the front end of the tacker against the target. Then, as shown in FIG. 3*c*, the connector 100' moves backward to the operating member 10 (in the direction of B), and the rear end of the connector 100' pushed back to the firing control plate 94, which is rotationally mounted on the lower rear end of the trigger 92 by the axle pin 96.

When the firing control plate 94 is moved backward by the connector 100', the piston valve rod 12 will be pushed back into the cylinder of the operating member 10 by its stroke.

Under the above state, when the user pulls the trigger 92, as shown in FIG. 3*d*, the lower end of the trigger 92 moves with respect to a rotating pin 97, which is mounted on the upper end of the trigger 92, in the direction of A. Then, the firing control plate 94, mounted on the trigger 92 by the axle pin 96, completely pushes back the piston valve rod 12 into the cylinder of the operating member 10. When the piston valve rod 12 is completely pushed back its stroke into the cylinder of the operating member 10, the nail loaded in the ejection guide 4 is fired.

At this time, the upper end of the anti-double firing controller 102 is engaged into the detent 100*a'* formed in the connector 100'. Thereby, the anti-double firing controller 102 does not allow the connector 100' moving backward to push the firing control plate 94 for the single firing mode.

Under the above situation, it will prevent to fire a nail on a same target. After firing and releasing the trigger, the connector 100' moves forward to return the initial position. As the connector 100' moves forward, the anti-double firing controller 102 is unlatched the detent of the connector 100' when the trigger is returned to the initial position. In this moment, if the connector 100' is bounced backward due to the repulsive force of the firing, the connector 100' will push backward to the firing control plate 94. Since the connector 100' is blocked by the anti-double firing controller 102, the bounced connector 100' by the repulsive force won't push back the firing control plate 94.

Even though the trigger 92 is pulled in the direction of A under the above situation, the piston valve rod 12 is not activated for the next shooting. In order to perform the next firing, the user must pull the trigger 92 again in the direction of A while the tip of the connector 100' is contacted and depressed on the next target.

FIGS. 4A, 4B, 4C, and 4D are transversal views illustrating the constitution and operation of the anti-double firing means in a continuous firing mode using the tacker with the anti-double firing means in accordance with the embodiment of the present invention.

In the continuous firing mode using the tacker with the anti-double firing means in accordance with the embodiment of the present invention, the anti-double firing plate 102 must not disturb the movement of the connector 100'. That is, when the connector 100' moves, the anti-double firing plate 102 must not disturb the movement of the connector 100'.

Figure 4A:
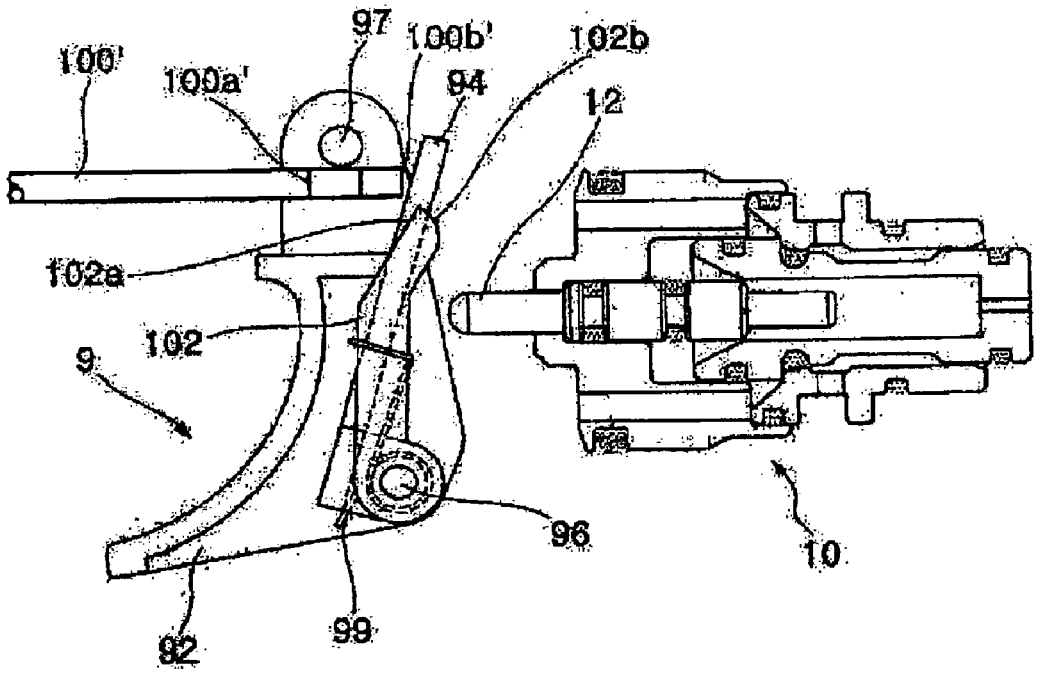
FIGS. 4A, 4B, 4C, and 4D are transversal views illustrating the constitution and operation of the anti-double firing means in a continuous firing mode using the tacker with the anti-double firing means in accordance with the embodiment of the present invention.
Figure 4B:
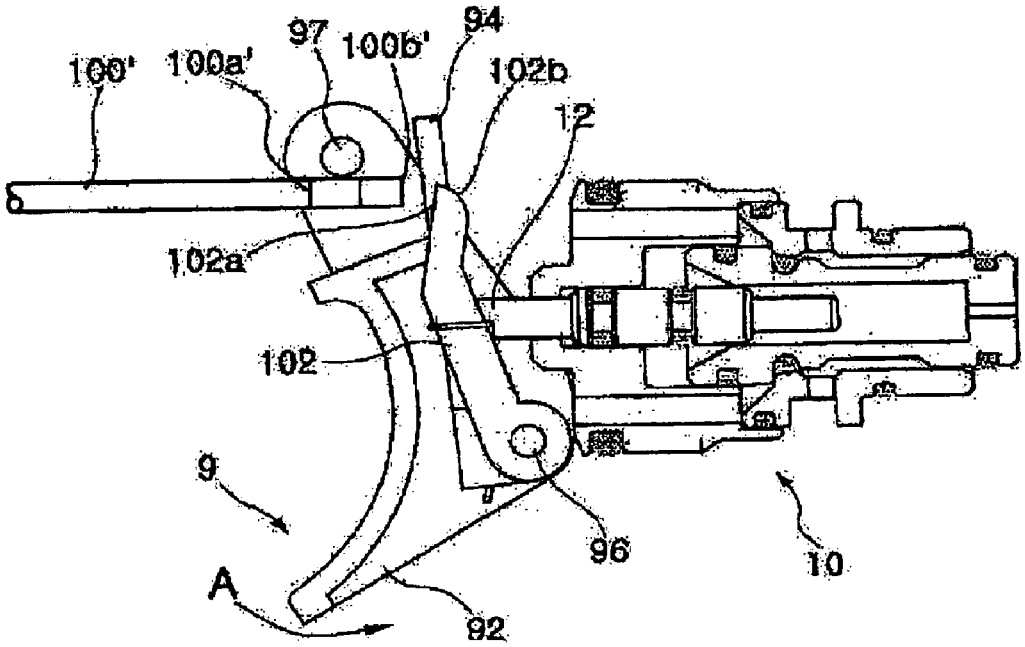
Figure 4C:
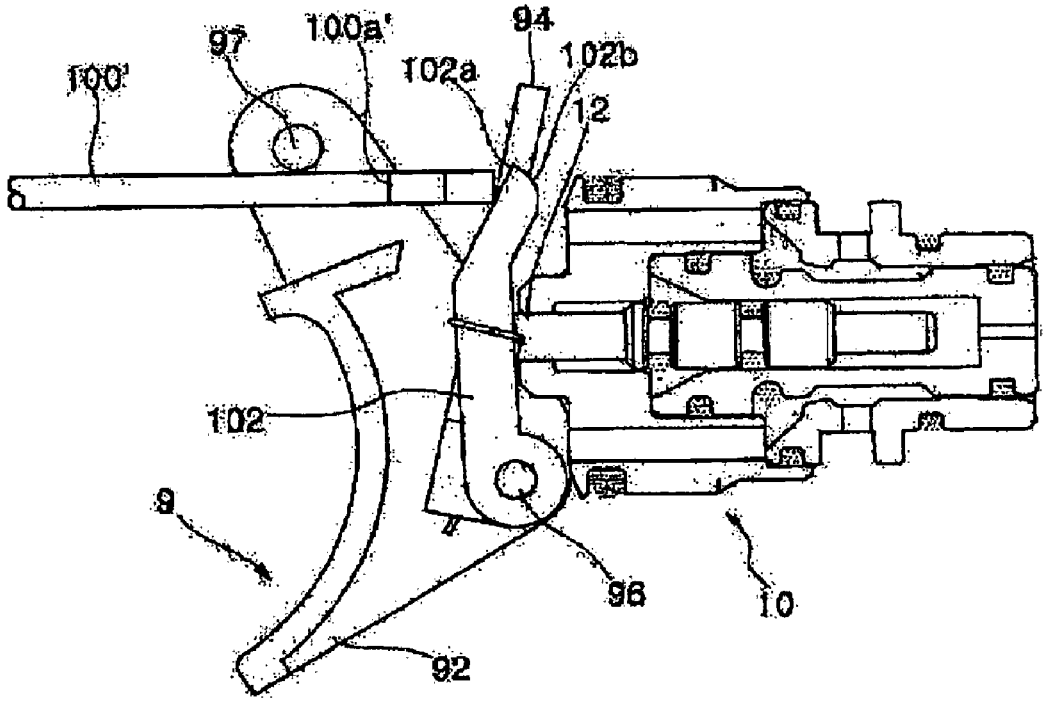

In the continuous firing mode, when a user pulls the trigger 92 in the direction of A in the initial state as shown in FIG. 4A, the pushing plate 94 contacts the valve rod 12 as shown in FIG. 4B. Then, the front end of the tacker is pressed against a target site of an object, thereby moving the connector 100' toward the operating member 10 (in the direction of B) and causing the connector 100' to press the valve rod 12 to fire a nail into the target site. When the tacker is switched from the single firing mode to the continuous firing mode, the anti-double firing plate 102 is laid on the side surface of the pushing plate 94, thus not disturbing the movement of the connector 100'.

Figure 4D:
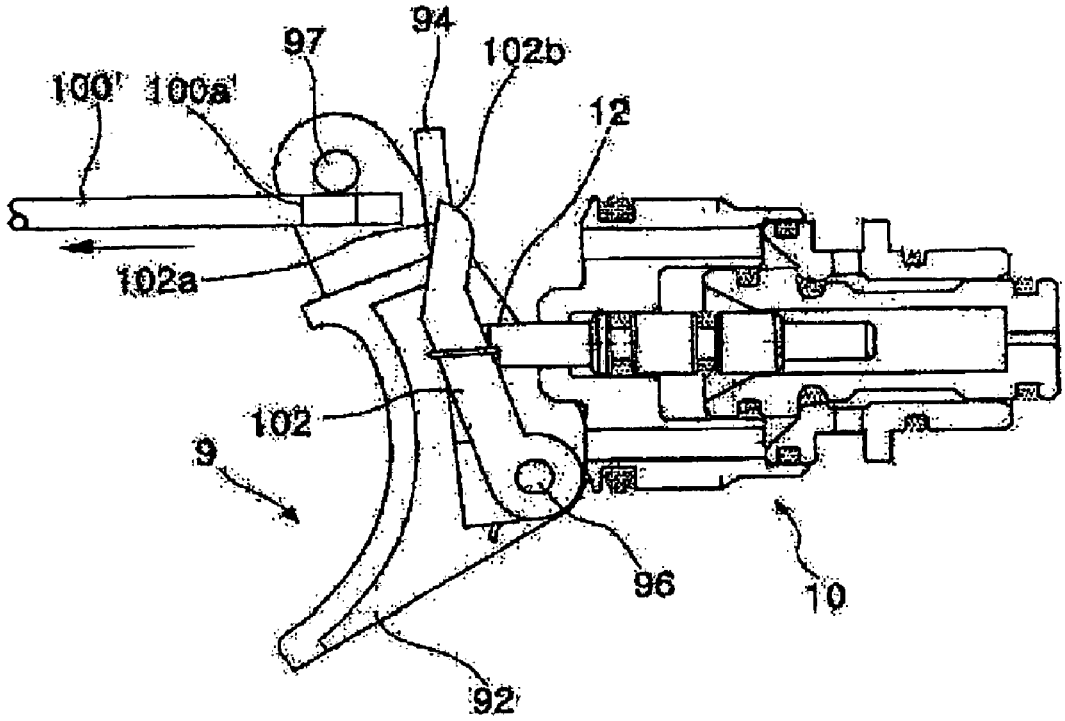

The trigger 92 has been pulled in the direction of A after firing, and, when the tacker is separated from the target site, the connector 100' moves forward as shown in FIG. 4D.

If the number of target sites of an object is three and the target sites are in close proximity, the user pulls the trigger 92 in the continuous firing mode, and presses the connector 100' against one target site of the object, thereby causing one nail to be launched toward the first target site of the object. Then, the user moves the tacker under the condition that the trigger 92 is pulled, and presses the connector 100' against another target site of the object, thereby causing other nails to be continuously launched toward the second and third target sites of the object. Since the anti-double firing plate 102 is located on the side surface of the pushing plate 94, the anti-double firing plate 102 does not disturb the movement of the connector 100', thus allowing the tacker to precisely perform a continuous firing operation.

As apparent from the above description, the present invention provides a tacker with anti-double firing means for use in a single firing mode, which restrains double firing of nails caused by the repulsive force of a connector to prevent arbitrary firing of nails caused by the repulsive force, thereby precisely performing a single firing operation.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. An anti-double firing devise equipped in a tacker that is consisting of a body, an ejection guide located in front of the body, a set of pneumatic mechanisms mounted inside of the body for striking a nail, a cover for protecting the pneumatic mechanisms, a handle grip, a trigger and a magazine for supplying the nails to the ejection guide, said anti-double firing devise comprising:

a connector (100') forming a solid bar disposed in parallel to the ejection guide (4) for linearly moving back and forth when the tacker is pressed and released on a work target, a detent (100*a'*) forming a tiny rectangular shaped cutout on an end of said solid bar connector (100'), a firing control plate (94) for pushing back or releasing a piston valve rod (12) of an operating unit (10) according to a linear movement of said solid bar connector (100') when the work target is pressed on, and an anti-double firing controller (102) forming an index-finger shape with a slightly bent-back finger tip, fiat top surface and rounded-tip lower surface for easily latching to said detent (100*a'*) located on the solid bar connector (100') when the trigger (9) is pulled at a single tiring mode, so, the single firing operates that a front tip of the tucker is depressed on the work target, said solid bar connector (100') is being pushed backward, at same time, the firing control plate (94) is being pushed backward by the solid bar connector (100'), then the trigger is pulled for the single firing, said anti-double firing controller (102) is simultaneously latched to the detent (100*a'*) of the solid bar connector (100') for blocking a bouncing back and forth movement of said solid bar connector (100'), which occurs recoiling due to repulsion of said solid bar connector (100') to prevent a subsequent misfiring on the same work target at the single firing mode, without locking the firing control plate (94) and the piston valve rod (12), wherein said anti-double firing controller (102) having narrower width than that of the trigger (9) with almost same height of the trigger (9) is installed in parallel to the trigger (9) and said anti-double firing controller (102) and the firing control plate (94) are mounted to pivot co-axially on an axle pin (96) and a coil spring (99) at a lower portion corner back of the trigger (9) for exerting a resilient force in a counter-clockwise direction to maintain its initial position.

* * * * *